United States Patent [19]

Heppe

[11] 4,267,421

[45] May 12, 1981

[54] APPARATUS FOR THE SUCCESSIVE WELDING OF C-SHAPED, PRE-BENT, INTERLINKED CHAIN LINKS

[75] Inventor: Karl-Julius Heppe, Cologne, Fed. Rep. of Germany

[73] Assignee: Meyer, Roth & Pastor, Cologne, Fed. Rep. of Germany

[21] Appl. No.: 131,549

[22] Filed: Mar. 18, 1980

[30] Foreign Application Priority Data

Mar. 30, 1979 [DE] Fed. Rep. of Germany ..... 2912677

[51] Int. Cl.[3] ..... B21L 3/02

[52] U.S. Cl. ..... 219/51; 59/31

[58] Field of Search ..... 219/51, 52; 228/192; 59/22, 31, 32, 33, 34

[56] References Cited

U.S. PATENT DOCUMENTS

| | | | |
|---|---|---|---|
| 1,474,824 | 11/1923 | Hoff et al. | 219/51 |
| 2,405,510 | 8/1946 | Maytag | 219/51 |
| 4,051,667 | 10/1977 | Lange | 59/31 |
| 4,075,451 | 2/1978 | Wüst | 219/51 |
| 4,133,999 | 1/1979 | Ebel et al. | 219/51 |
| 4,149,058 | 4/1979 | Rahn | 219/51 |

FOREIGN PATENT DOCUMENTS

| | | | |
|---|---|---|---|
| 2347768 | 7/1975 | Fed. Rep. of Germany . | |
| 2446179 | 4/1976 | Fed. Rep. of Germany | 59/31 |

*Primary Examiner*—Thomas J. Kozma
*Assistant Examiner*—Keith E. George
*Attorney, Agent, or Firm*—Spencer & Kaye

[57] ABSTRACT

Apparatus for the successive welding of C-shaped, pre-bent interlinked chain links forming a chain. The apparatus comprises a saddle for supporting a chain link to be welded, the saddle having a trough and cup-shaped recesses at each end of the trough for accommodating the link. Guides are provided on either side of the saddle for guiding the chain links entering and leaving the saddle and clinchers are also provided for gripping the chain link during welding and following completion of the welding operation. The guide for the chain links entering the saddle is provided with a chain sprocket having crossed slots, and is pivotable about its axis to permit rotation of the link in the saddle after welding has been completed. The clinchers have claw-like recesses in their end for gripping the rounded portions of the chain link to be welded and the clincher adjacent the guide for the chain link entering the saddle has a trough-shaped recess for guiding the following link.

5 Claims, 9 Drawing Figures

APPARATUS FOR THE SUCCESSIVE WELDING OF C-SHAPED, PRE-BENT, INTERLINKED CHAIN LINKS

BACKGROUND OF THE INVENTION

The present invention relates to an apparatus for the successive welding of C-shaped, pre-bent, interlinked chain links formed into a chain. More particularly, it relates to an apparatus comprising welding electrodes, a saddle to support a chain link being welded, guides arranged at both sides of the saddle in an inclined orientation for the incoming and outgoing chain links as well as two clinching members, or clinchers, which are positioned against the curved portions of the chain link being welded.

German Auslegeschrift No. 2,347,768 discloses an apparatus of the above-mentioned type in which the chain to be welded is led along guides in such a manner that the individual chain links each assume a position which is inclined by 45° with respect to the plane of the guide. The saddle is provided with a vise-like device with which the chain link to be welded, which enters at an angle of 45° with respect to the horizontal plane, is placed in an upright position so that the clinchers and the electrodes can be attached. The welding process then takes place in the usual manner. In this prior art device, the turning process for the link being welded is effected by a device which is located directly at the saddle in an area of the apparatus in which, particularly when welding shortlinked chains, there is very little space for the necessary tools, i.e., the saddle, clinchers and electrodes.

It is, therefore, an object of the present invention to effect the righting process, whereby the link to be welded is placed in an upright position, by providing apparatus having righting means disposed outside of the saddle area.

SUMMARY OF THE INVENTION

In accordance with the invention, an entrance-side guide is provided which is mounted for pivoting through an angle of 90° about its longitudinal axis. The entrance-side guide is connected to a pivot drive and this guide is further provided, at its end facing a saddle, with a chain sprocket having crossed slots. The saddle is provided with a trough corresponding to the wire diameter of the chain link to be welded for accommodating the back of the chain link, and the sides of the saddle facing the guides have cup-shaped recesses comforming to the rounded portions of the two adjacent chain links. A clincher disposed at the entrance side of the saddle is provided with a claw-like recess in one end, and a trough-shaped recess on its underside. The clincher at the entrance side of the saddle is connected to a drive which, after release of the clincher and turning of the just welded chain link by 90°, places the clincher so that its trough-shaped recess contacts the incoming chain link.

This arrangement has the advantage that the turning device, including its drive, is located outside the welding station thereby greatly simplifying the connection to the drive. Turning of the chain link entering the saddle is effected by means of the guide at the entrance side which is provided with crossed slots. The chain link enters the welding position already in an upright position, being guided along its back by the trough in the saddle while the straight side of the chain link opposite its back is held by the trough-shaped recess in the clincher. During this part of the chain transport, the clincher remains in such a position that the rear rounded portion of the link to be welded, when seen in the direction of advancement of the chain, moves from the trough-shaped recess into the claw due to a corresponding downward movement of the clincher. In this way, the link to be welded is guided with precision during the entire movement of the chain and is held accurately by the claw of the clincher on the entrance side of the saddle when the transporting movement comes to a stop. As soon as the clincher at the exit side contacts the chain link, this link is held in a precise desired position so that the electrodes can then be attached and the welding process take place in the usual manner.

U.S. Pat. No. 2,405,510 discloses apparatus for the successive welding of interlinked links of a chain with the turning process taking place with the aid of two cross-slitted sleeves, one of which is disposed at the entrance side and the other at the exit side of a chain-supporting block, both sleeves being pivotal through 90° about their longitudinal axes. This known arrangement cannot be used for welding machines in which the chain to be welded is brought at an angle over a stationary welding saddle because, for the welding process, particularly for chains with short links, it is necessary to apply the clinchers to the rounded portions of the link to be welded.

In a further embodiment of the present invention, the guide at the entrance side has a tubular shape. An advantage of such an arrangement is that the fabrication and structure of the entrance-side guide are simple. Also, the chain is held freely in the portion of the guide lying in front of the chain wheel making tangling extremely unlikely or impossible.

In a still further embodiment of the invention, the chain sprocket is removably connected to the guide. This permits manufacture of the crossed slits for the size of chain link to be welded to be accomplished with such close tolerances that precise guidance of the chain is assured during the turning process and yet the apparatus can be used, in the usual manner, for a range of different chain link sizes. This is made possible by installation of a chain sprocket adapted to the particular chain link type being processed.

In still another embodiment of the invention, the exit guide is provided, at its end facing the saddle, with a tubular or trough-shaped entrance portion followed by the part of the guide which is provided with the chain transporting device. Since the chain transporting devide must assure that the individual chain links remain stationary with respect to one another so that the chain transport takes place without malfunction and so that a predetermined clamping force can be applied in the direction of chain movement, a guide of sufficient length is provided between the chain transporting device and the saddle to permit a certain amount of turning of the outgoing chain corresponding to the turning movement in the region of the welding station.

DESCRIPTION OF THE PREFERRED EMBODIMENTS

Figure 1:
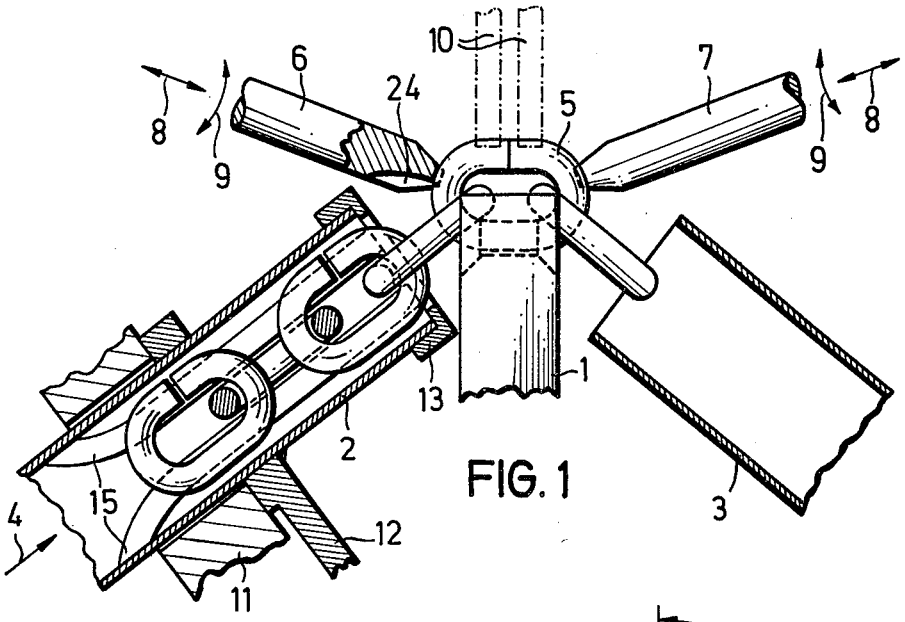
FIG. 1 is a side view of the welding station of the present invention.

FIG. 1 shows schematically only those elements which are necessary for an explanation of the design and operation of a welding device for chain links according to the invention. These elements are fastened in a machine frame in a manner known in the prior art and are connected with the usual drive means of a chain link welding machine. The individual elements are shown in FIG. 1 in their mutual association as it exists during the welding process.

The apparatus includes a saddle 1 which is fixed to the machine frame and has a shape which will be explained in detail in connection with FIGS. 2 and 3. Adjacent both sides of the saddle 1 there are guides 2 and 3 over which the chain to be welded is transported in the direction of arrow 4 in synchronsim with the welding operation. The guides 2 and 3 are arranged at an inclined position with respect to the saddle so that the chain portion to be welded ascends from the bottom toward the top on the entrance side and descends from the saddle on the exit side. As shown in FIG. 1, this arrangement of the guides exposes the rounded portions of the particular chain link 5 disposed on the saddle 1.

Above each end of the guides 2 and 3 facing the saddle 1 there are located clinchers 6 and 7, respectively, which engage the rounded portions of the chain link 5 facing each of the clinchers. Both clinchers are connected to drive and control device (not shown) so that they can be retracted in the longitudinal direction from the illustrated position and advanced again in the directions shown by the double arrows 8. The two clinchers can be pivoted upwardly from the illustrated position in the direction of the double arrow 9, and back again. Welding electrodes 10, which are shown by dashed lines, contact the free, pre-bent ends of the chain link to be welded.

In the illustrated embodiment, the guides 2 and 3 have a tubular shape in the region immediately adjacent the saddle, the diameter of the tube being large enough to permit the thickest type of chain to be processed on the machine to be pulled through freely. At a given minimum distance from the saddle, the configuration of the guide 3 is changed to that of a conventional guide formed by two parallel juxtaposed bars (not shown) so that conventional chain transporting and tensioning devices can be used. The length of the tubular portion of the guide 3 is such that the chain disposed between the saddle 1 and the beginning of the guide formed of the parallel bars can be twisted without difficulty when it is rotated by 90° about the longitudinal axis of the chain in the area of the saddle. The exit side guide 3 is fixed to the machine frame.

The entrance side guide 2, which may be tubular over its full length, is mounted in a ring bearing 11 in the machine frame so that it may be pivoted back and forth through an angle of 90°. The guide 2 is pivoted back and forth about its longitudinal axis in synchronism with the machine operation by a lever 12 which is fixed to the tubular guide 2 and has a free end connected, in a manner not illustrated in detail, to the driving and controlling devices of the machine.

Figure 4:
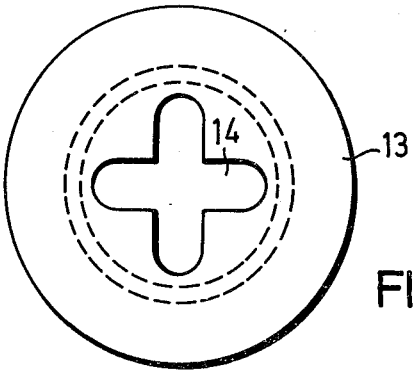
FIG. 4 is a front view of the welding station chain sprocket.

The end of the guide 2 facing the saddle 1 is terminated by a chain sprocket 13 (FIG. 4) provided with crossed slits 14 corresponding to the dimensions of the chain to be welded. The chain sprocket 13 is releasably attached over the end of the guide 2 so that, within the operating range of the apparatus, a chain sprocket can be inserted which corresponds to the size of the chain to be welded.

In the area of the guide 2 facing the saddle 1, there are further provided guide elements 15 adjacent the chain sprocket 13. These guide elements may be made, for example, of two diametrically opposed pairs of bars which hold the links of the chain to be guided in this region by their end portions. Thus, immediately before passage through the chain sprocket 13, the chain links are guided at an angle of 90° with respect to one another.

Figure 2:
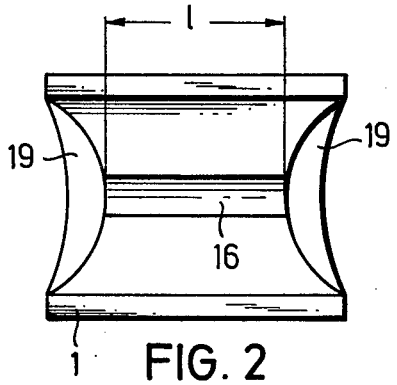
FIG. 2 is a top view of the welding station saddle.
Figure 3:
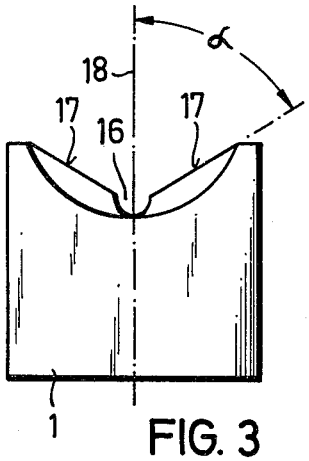
FIG. 3 is a front view of the saddle.

FIGS. 2 and 3 show the saddle 1 in top and front views, respectively. As can be seen in these illustrations, the upper side of the saddle is provided with a trough-shaped recess 16 having a radius corresponding to the wire diameter of the chain links to be welded. At both sides of the trough-shaped recess 16 of the saddle 1 there are upwardly ascending faces 17 making an angle with a vertical plane passing through the trough-shaped recess 16. In a preferred embodiment of the invention, $\alpha = 60°$.

Each frontal face of the saddle 1 provided with a cup-shaped recess 19 having a radius corresponding to the radius of curvature of the chain links to be welded. The length 1 of the trough-shaped recess 16 in the saddle, as delimited by the cup-shaped recesses 19, corresponds approximately to the length of the straight portion of the chain link being welded.

Figure 5:
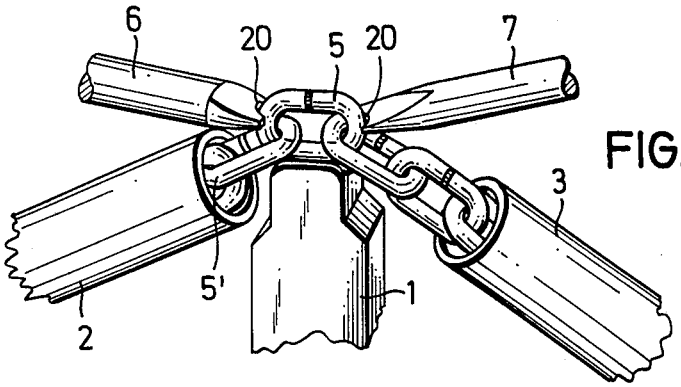
FIGS. 5 through 9 show individual steps in the sequence of movements of the chain link turning process.
Figure 6:
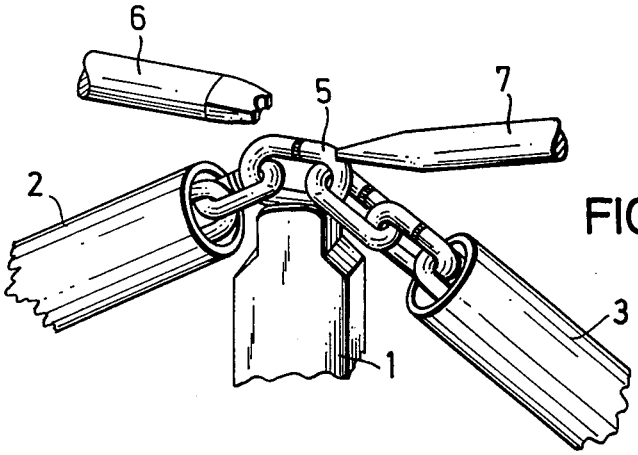
Figure 7:
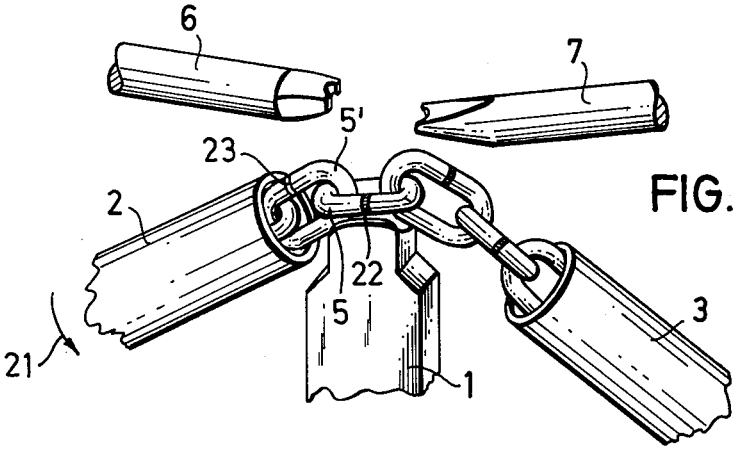

The operation of the above apparatus will be explained in detail with the aid of FIGS. 5 through 9, the electrodes 10 not being shown in these illustrations. FIG. 5 shows the relationship of the individual elements with respect to each other immediately after termination of the welding process. In FIG. 5, the welded chain link 5 is still being pressed together by the two clinchers 6 and 7 pressing against its rounded portions. The rounded portions of the chain link 5 are held by the claw-shaped recesses 20 against the tips of the clinchers 6 and 7 which are adapted to the wire diameter of the link to be welded. Immediately after removal of the electrodes, the drive of the device retracts clinchers 6 and 7 and lifts them upward as shown in FIG. 6. Since the link is now held in the trough-shaped recess 16 of the saddle 1 only by the links at its ends, the guide 2 is turned about its longitudinal axis in the direction of arrow 21 so that the just-welded link 5 rests flatly on the saddle 1. The weld 22 of the just-welded link then points in the forward direction. This rotation causes the following link 5′ whose rear rounded portion is still located within the crossed slits of the chain sprocket 13 to be rotated to a perpendicular position so that the welding gap 23 now lies at the top.

Figure 8:
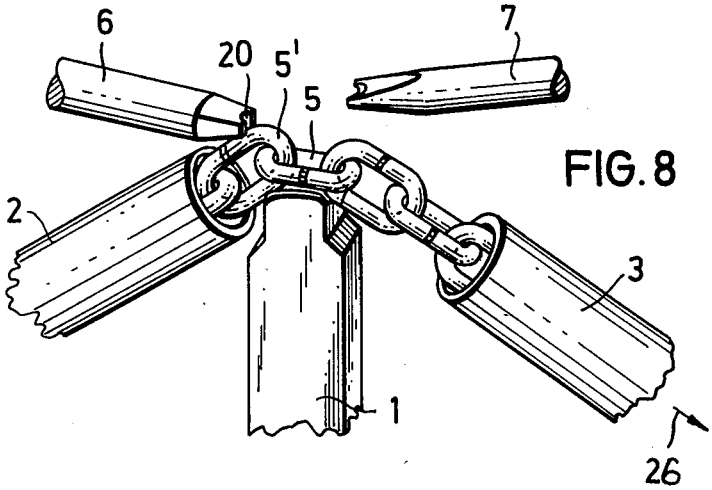
Figure 9:
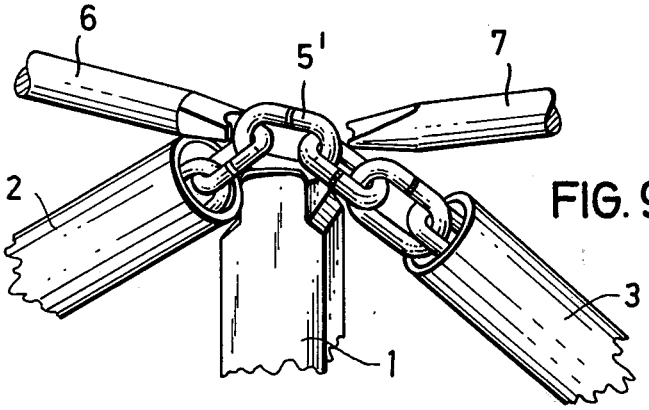

As shown in FIG. 8, the clincher 6 is now lowered so that its trough-shaped recess 24 rests on the portion of link 5′ to be welded. As soon as the clincher 6 rests on the link 5′ to be welded, the chain transport is actuated so that the chain is pulled across the saddle 1 in the direction of the arrow 26. The start of this transporting movement is shown in FIG. 8. As can be seen in FIG. 8, the rear end of the link 5′ to be welded at this moment is still being held in the crossed slits 14 of the chain sprocket 13 while the lower portion of its leading end has already entered the trough-shaped recess 16 in saddle 1. The lower portion of link 5′ is held in recess 16 and the upper portion is held by the trough-shaped recess 24 of the clincher 6 which rests, by its own weight, on link 5'. During this entire process, the clincher 7 remains in the raised, retracted position.

Upon termination of the transporting stroke (FIG. 9), the link 5' to be welded is now held over the full length of its lower portion by the trough-shaped recess 16 in the saddle 1 while the rear end slides through the trough-shaped recess 24 of clincher 6 and enters the claw-shaped recess 20 of clincher 6 so that it will be forcibly held in the intended upright position. Thereafter, clincher 7 is lowered and advanced in the direction toward link 5' so that the latter is gripped by the clinchers in the manner shown in FIG. 5 and the welding gap is pressed together.

Once the welding electrodes have been applied, the usual welding process is carried out with a subsequent clinching stroke via clinchers 6 and 7 so that after raising of the welding electrodes, the above-described operating sequence can be resumed. In this portion of the sequence, guide 2 is pivoted backwardly opposite to the direction shown by arrow 21 in FIG. 7.

The weld can be deburred in the usual manner immediately after removal of the electrodes and before release of the clinchers.

It will be understood that the above description of the present invention is susceptible to various modifications, changes and adaptations, and the same are intended to be comprehended within the meaning and range of equivalents of the appended claims.

What is claimed is:

1. Apparatus for the successive welding of C-shaped, pre-bent interlinked chain links forming a chain, comprising a saddle for supporting a given chain link to be welded, said saddle having a trough for accommodating the back portion of said given chain link and first and second cup-shaped recesses at each end of said trough for accommodating the rounded portions of the two chain links of said chain following and leading said given chain link;

first and second guides positioned on either side of said saddle adjacent said first and second cup-shaped recesses, respectively, for guiding the chain chain links entering and leaving said saddle, respectively, said first and second guides each having a longitudinal axis inclined at an angle with respect to the axis of said trough, said first guide being pivotable about its longitudinal axis;

a chain sprocket having crossed slots secured to the end of said first guide adjacent the first cup-shaped recess of said saddle, said chain links passing through said crossed slots; and first and second clinchers movably mounted adjacent said first and second guides and provided with claw-like recesses in their ends for gripping the rounded portions at each end of the chain link to be welded, said first clincher having a trough-shaped recess on the lower portion thereof adjacent its claw-like recess, the trough-shaped recess of said first clincher guiding the following link of said chain after said given link has been welded and rotated by the pivoting of said first guide about its longitudinal axis.

2. Apparatus as defined by claim 1 wherein said first guide for guiding the chain links entering said saddle is tubular.

3. Apparatus as defined by claim 1 or 2 wherein said first guide is pivotable about said longitudinal axis through an angle of 90°.

4. Apparatus as defined in claim 1 or 2 wherein said chain sprocket is removably connected to said first guide.

5. Apparatus as defined by claim 4 wherein said first guide is pivotable about said longitudinal axis through an angle of 90°.

* * * * *